US011058165B2

(12) United States Patent
Smith et al.

(10) Patent No.: US 11,058,165 B2
(45) Date of Patent: Jul. 13, 2021

(54) WEARABLE AUDIO DEVICE WITH BRIM-MOUNTED MICROPHONES

(71) Applicant: Bose Corporation, Framingham, MA (US)

(72) Inventors: Matthew Christopher Smith, Needham Heights, MA (US); Alaganandan Ganeshkumar, North Attleboro, MA (US); Thomas David Chambers, Bellingham, MA (US); Richard Lionel Lanoue, III, Whitinsville, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/571,425

(22) Filed: Sep. 16, 2019

(65) Prior Publication Data

US 2021/0076770 A1 Mar. 18, 2021

(51) Int. Cl.

| | |
|---|---|
| ***A42B 3/30*** | (2006.01) |
| ***G10L 25/48*** | (2013.01) |
| ***H04R 1/08*** | (2006.01) |
| ***H04R 1/10*** | (2006.01) |

(52) U.S. Cl.

CPC ..... *A42B 3/30* (2013.01); *G10L 25/48* (2013.01); *H04R 1/086* (2013.01); *H04R 1/1083* (2013.01)

(58) Field of Classification Search

CPC ..... A42B 3/30; G10L 25/48; H04R 1/086; H04R 1/1083

USPC ... 381/56, 91, 122, 124, 301, 355, 361, 364, 381/367

See application file for complete search history.

(56) References Cited

U.S. PATENT DOCUMENTS

| | | | | |
|---|---|---|---|---|
| 10,311,889 | B2 | 6/2019 | Ganeshkumar et al. | |
| 2007/0261153 | A1* | 11/2007 | Wise | A42B 3/166 2/423 |
| 2010/0069002 | A1* | 3/2010 | Rong | H04M 1/6066 455/41.2 |
| 2013/0070935 | A1* | 3/2013 | Hui | G10L 21/0208 381/71.1 |
| 2017/0052000 | A1* | 2/2017 | White | A42B 3/288 |
| 2018/0270565 | A1 | 9/2018 | Ganeshkumar | |
| 2018/0336911 | A1* | 11/2018 | Dahl | G10L 21/0232 |

* cited by examiner

*Primary Examiner* — William A Jerez Lora
(74) *Attorney, Agent, or Firm* — Hoffman Warnick LLC

(57) ABSTRACT

Various implementations include a wearable audio device for enhancing the acoustic response proximate a user, for example, in the direction of the user's mouth. In particular implementations, a wearable audio device includes: a head mount having: a crown portion for resting on a head of a user, and a brim extending from the crown portion in a forward-oriented direction; and a plurality of microphones coupled to the brim of the head mount.

20 Claims, 4 Drawing Sheets

WEARABLE AUDIO DEVICE WITH BRIM-MOUNTED MICROPHONES

TECHNICAL FIELD

This disclosure generally relates to wearable audio devices. More particularly, the disclosure relates to wearable audio devices configured to enhance detection of voice signals in noisy environments.

BACKGROUND

Wearable audio devices can significantly improve communication between users in noisy environments, e.g., in industrial use applications, open-air environments, or other areas with high levels of background noise. Conventionally, these devices employ a "boom" microphone (e.g., microphone placed on a boom or arm) that is placed next to the user's mouth to aid in voice pickup and noise cancellation. While boom microphones can be useful for communication purposes, these microphones are not practical in all instances. For example, the user must actively position the boom to enhance effectiveness. Additionally, the boom and microphone can reduce the user's field of vision, creating challenges in a dynamic and/or dangerous environment.

SUMMARY

All examples and features mentioned below can be combined in any technically possible way.

Various implementations include wearable audio devices. The wearable audio devices are configured to enhance the acoustic response proximate a user, e.g., in the direction of the user's mouth.

In some particular aspects, the wearable audio device includes: a head mount having: a crown portion for resting on a head of a user, and a brim extending from the crown portion in a forward-oriented direction; and a plurality of microphones coupled to the brim of the head mount.

Implementations may include one of the following features, or any combination thereof.

In certain aspects, the wearable audio device further includes: a controller coupled with the plurality of microphones and configured to combine a plurality of signals from the plurality of microphones to provide an output signal having an enhanced acoustic response in a selected direction.

In some implementations, the selected direction is a direction of a mouth of the user.

In certain aspects, the selected direction is a forward-oriented direction.

In particular cases, the wearable audio device further includes a voice activity detection (VAD) system coupled to the head mount and the controller.

In some aspects, the wearable audio device further includes: an additional microphone located proximate a rear of the crown; and an accelerometer located proximate the additional microphone, where the VAD system is configured to use a noise pickup signal from the additional microphone to filter out acoustic noise in a signal from the accelerometer.

In some aspects, the VAD system includes at least one microphone selected from the plurality of microphones coupled to the brim of the head mount.

In certain implementations, the VAD system includes a vibration sensor.

In particular aspects, the wearable audio device further comprises a suspension system coupled with the head mount, where the vibration sensor is mounted to a back strap of the suspension system.

In certain cases, the vibration sensor is mounted to the head mount in a manner configured to detect vibration of the temple of the user, or in a manner configured to detect jaw vibration of the user.

In some implementations, the vibration sensor is mounted to an inside surface of the crown portion.

In particular aspects, the vibration sensor is an accelerometer for detecting vibration of bones of the user.

In certain cases, the wearable audio device further includes a transducer coupled to the head mount and the controller, the transducer configured to provide an audio output.

In some implementations, the transducer is an earbud.

In particular cases, the plurality of microphones comprises at least two microphones.

In certain aspects, each of the plurality of microphones is coupled to a lower surface of the brim.

In some implementations, an upper surface of the brim is shaped to shield the plurality of microphones from wind in the ambient environment.

In particular aspects, the head mount further includes a dome portion extending from the crown portion to cover a top of the head of the user.

In certain implementations, the head mount includes a rigid protective helmet or a hat.

In particular aspects, the brim extends from the crown portion by a distance that locates the plurality of microphones at a relative angle to the mouth of the user such that the plurality of microphones are positioned to enhance an acoustic response from user voice signals.

In certain cases, the plurality of microphones is positioned on the brim to enhance voice detection while ambient sound pressure level (SPL) exceeds approximately 75 decibels (dB).

In particular aspects, the wearable audio device further includes an additional microphone assembly coupled with the head mount, the additional microphone assembly including: an arm in a fixed position relative to the head mount; and at least one additional microphone coupled with the arm.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
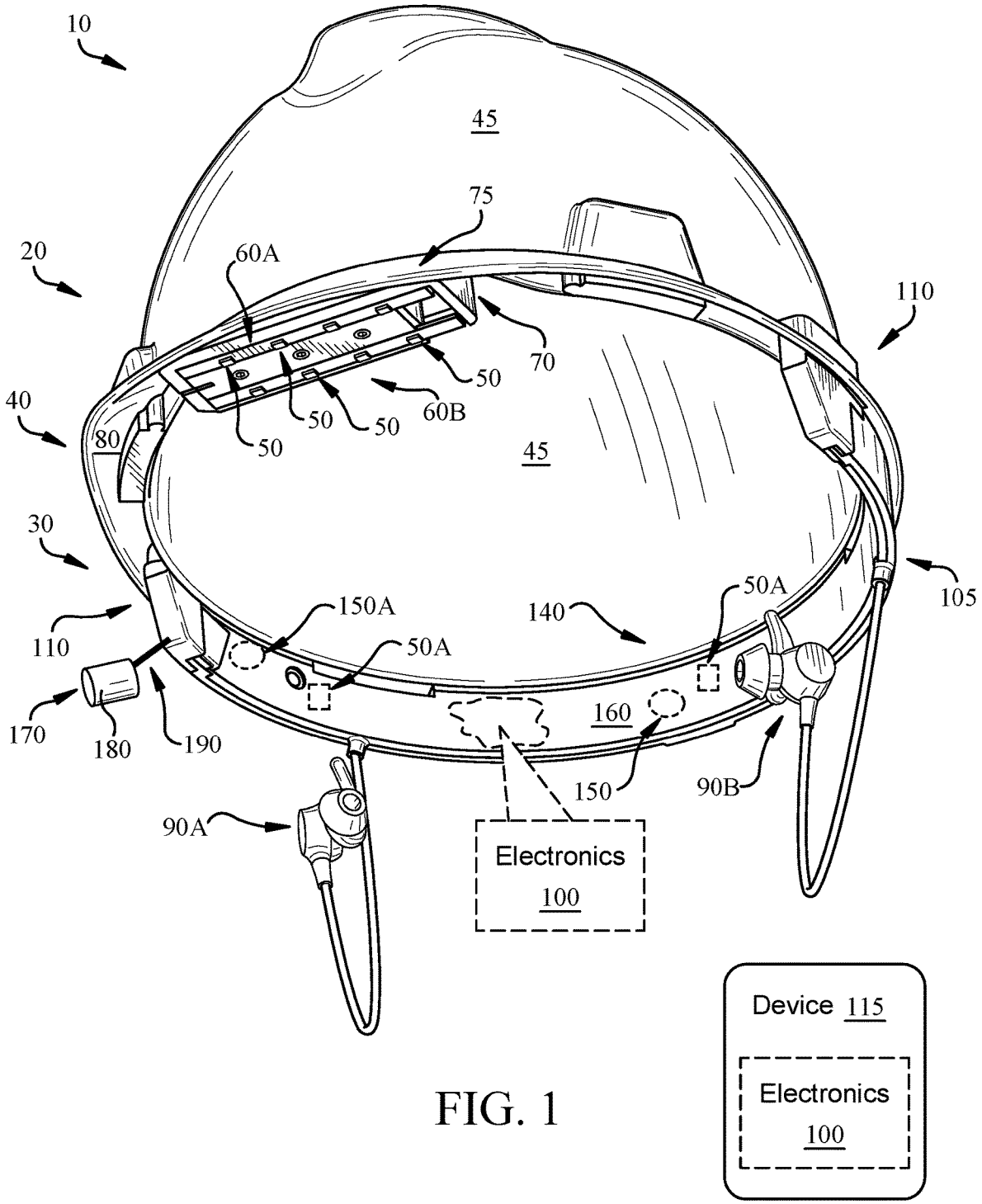
FIG. 1 is a perspective view of an example audio device according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a wearable audio device with brim-mounted microphones can effectively enhance voice pickup in noisy environments. For example, wearable audio devices disclosed according to implementations can provide a user with an effective, hands-free approach for communicating in noisy environments. The systems disclosed according to various implementations can improve communications in such environments.

Commonly labeled components in the FIGURES are considered to be substantially equivalent components for the purposes of illustration, and redundant discussion of those components is omitted for clarity.

Aspects and implementations disclosed herein may be applicable to a wide variety of speaker systems, such as wearable audio devices in various form factors, such as head-worn devices (e.g., helmets, hats, visors, headsets, headphones, eyeglasses), neck-worn speakers, shoulder-worn speakers, body-worn speakers (e.g., watches), etc. Some particular aspects disclosed may be applicable to personal (wearable) audio devices such as head-mounted audio devices, including helmets, hats, visors, eyeglasses etc. It should be noted that although specific implementations of speaker systems primarily serving the purpose of acoustically outputting audio are presented with some degree of detail, such presentations of specific implementations are intended to facilitate understanding through provision of examples and should not be taken as limiting either the scope of disclosure or the scope of claim coverage.

Figure 2:
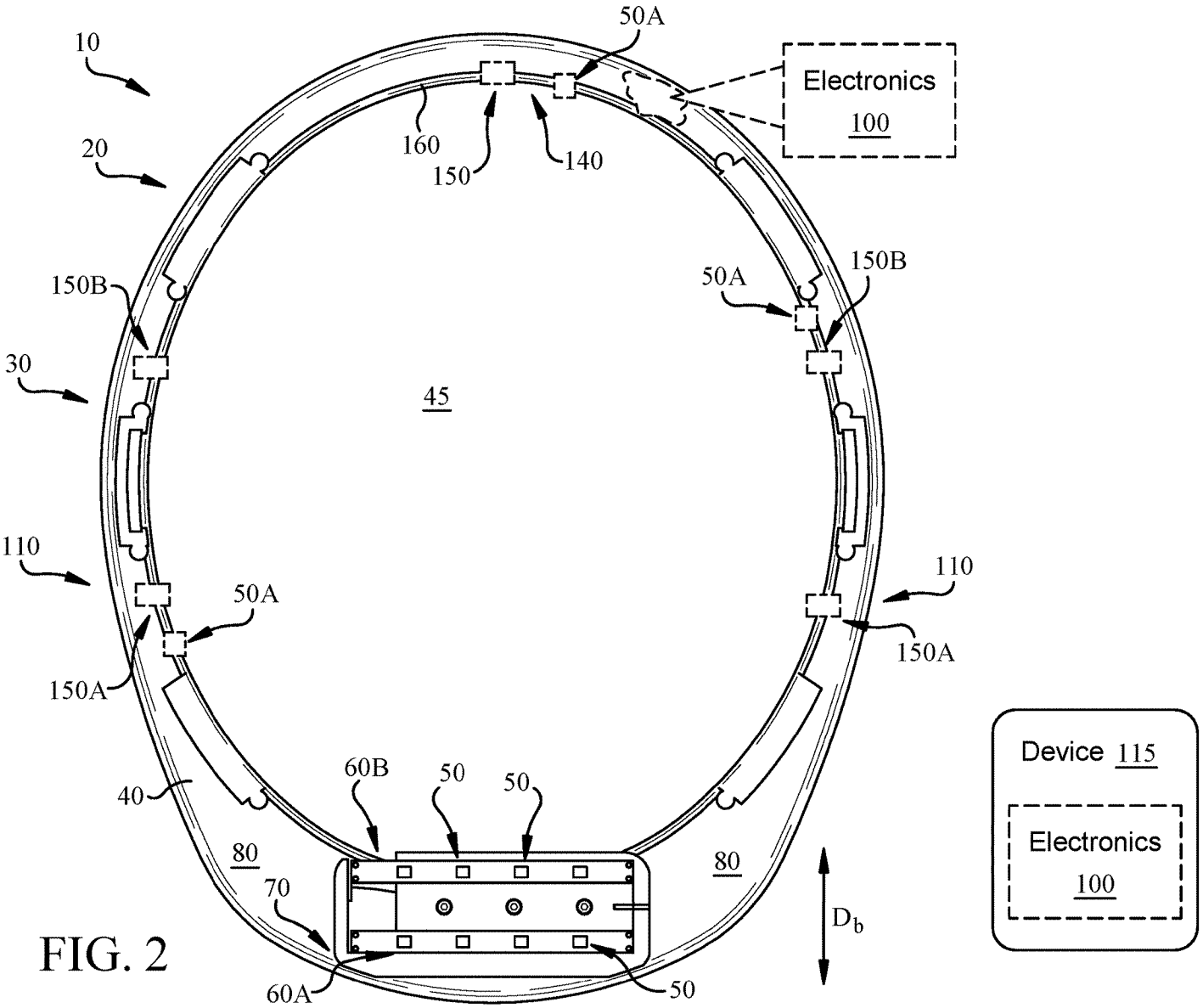
FIG. 2 is a plan view of the audio device of FIG. 1, according to various implementations.

FIG. 1 is a schematic perspective view of a wearable audio device 10 according to various implementations. FIG. 2 shows a plan view of the wearable audio device (or simply, "audio device") 10. In this depicted example, the audio device 10 is a head-mounted device configured to fit on or over the head of a user. In some particular cases, the head-mounted device is a helmet (e.g., rigid protective helmet), a hat, a visor, or a headset. Additional form factors are also possible. For example, components of the audio device 10 can be configured to couple with another body-worn or head-worn device, garment, etc., such as a baseball-style cap or other hat. In these examples, the components of the audio device 10 can be configured to couple/decouple with such a body-worn or head-worn device or garment.

In the particular example of a head-mounted audio device 10 depicted in FIGS. 1 and 2, the audio device 10 includes a head mount 20 that has a crown portion (or simply, "crown") 30 and a brim 40 extending from the crown 30. In some cases, the crown 30 is configured to rest on the user's head, and the brim 40 extends from the crown 30 in a forward-oriented direction. That is, the brim 40 is positioned to extend from the crown 30 in the user's forward-facing direction, and overhang the user's facial features (e.g., nose, mouth, forehead, brows, etc.). In certain cases, such as where the audio device 10 includes a helmet, a hat or other over-the-head style device, the audio device 10 includes a dome portion 45 extending from the crown 30 to cover the top of the user's head.

As noted herein, the audio device 10 can also include an additional suspension system for directly coupling the crown 30 to the user's head in some implementations. For example, as depicted in the simplified perspective view of an audio device in FIG. 3, the audio device 10 can include a suspension system 52 coupled with the head mount 20 for directly mounting on the user's head (example user depicted in FIG. 3). In these cases, the suspension system 52 can include a back strap 54 that is configured to rest proximate the rear of the user's head, and in some cases, includes an adjustment mechanism 56 for adjusting the fit of the suspension system 52. The suspension system 52 can be particularly beneficial in adjusting the fit of the audio device 10 where the head mount 20 includes a rigid, protective structure such as a hard had or helmet.

Figure 3:
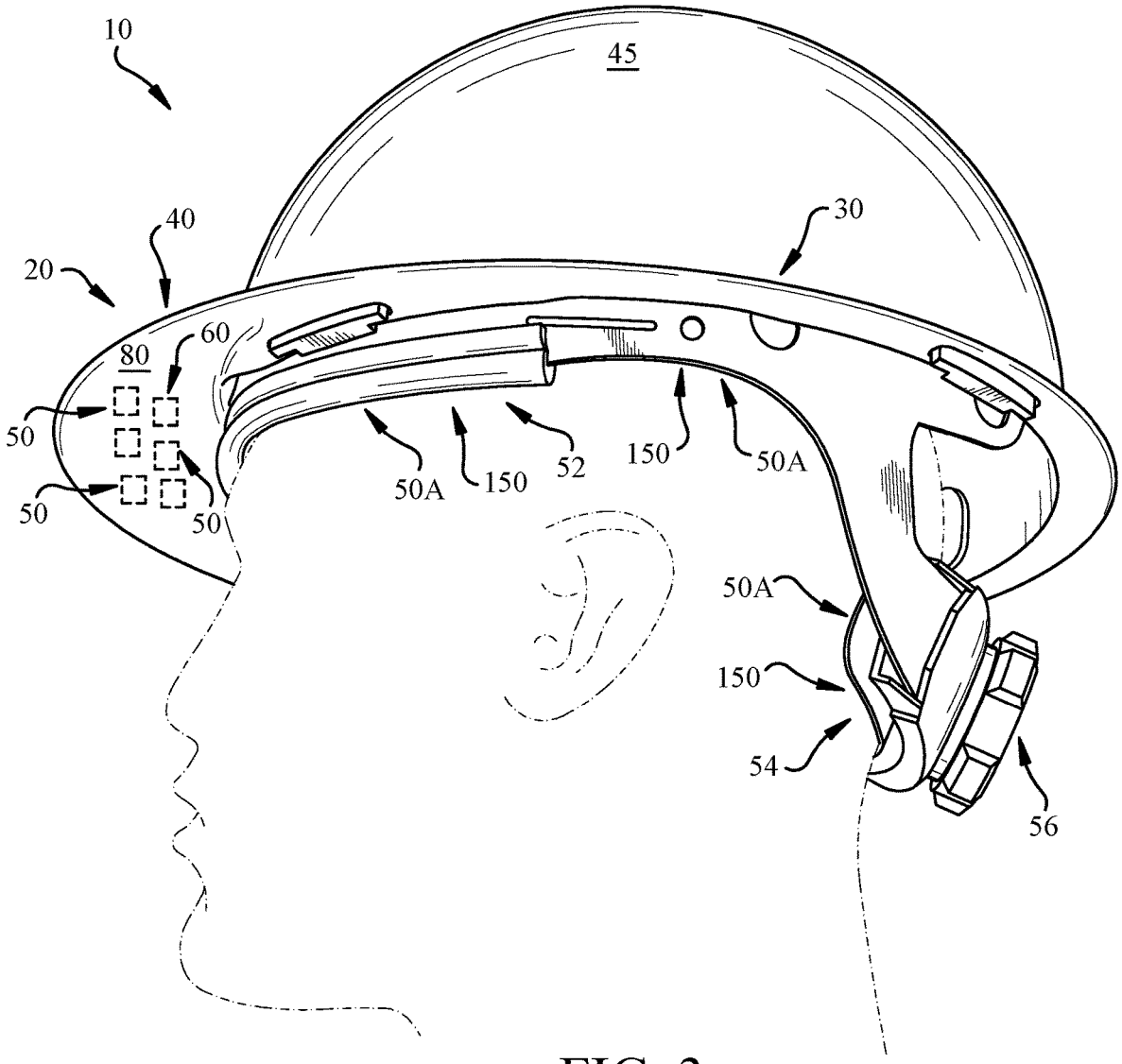
FIG. 3 shows a simplified perspective view of an audio device, illustrating a suspension system, according to various implementations.

With continuing reference to FIGS. 1 and 2, as well as reference to FIG. 3, in certain implementations, the audio device 10 also includes a plurality of microphones 50 coupled to the brim 40. In particular cases, the plurality of microphones 50 includes two or more microphones. In more specific implementations, the plurality of microphones 50 includes an array of microphones including 3, 4, 5, 6, 7, 8 or more microphones 50. In some cases, the microphones 50 are arranged in one or more arrays, e.g., 1×2 array, 2×2 array, 2×3 array, 3×3 array, 3×4 array, 4×4 array, etc. In one particular example, as shown in FIGS. 1 and 2, the microphones 50 can be arranged in two arrays 60 (e.g., 1×n arrays), which are approximately parallel with one another. These arrays 60 can each include two or more microphones, and in some cases, four microphones or more. The arrays 60 are shown side-by-side, such that one array 60A is located closer to the outer span of the brim 40 than the other array 60B. In some cases, the microphones 50 are indirectly coupled with the brim 40, e.g., contained in a housing 70, that is coupled with the brim 40. In other cases, the microphones 50 are directly coupled with the brim 40 or some other part of the audio device 10.

In various implementations, the brim 40 has an upper surface 75 and a lower surface 80 opposing the upper surface 70. In a forward-oriented position, the lower surface 80 faces generally downward toward the floor or the user's feet. In various implementations, as shown in FIGS. 1 and 2, the microphones 50 are coupled with a lower surface 80 of the brim 40. That is, the microphones 50 are generally oriented in the downward-facing direction. In additional implementations, one or more groups of microphones 50 (e.g., arrays 60A and/or 60B) are aligned at an angle relative to the vertical orientation, e.g., in some cases the microphones in array 60B are aligned at an angle toward the direction of the user's mouth. As noted herein, the upper surface 75 of the brim 40 can be shaped to shield the microphones 50 from wind in the ambient environment. That is, the positioning of the microphones 50 on the lower surface 80 of the brim 40 aids in reducing detected wind noise at the microphones 50, and as further noted herein, can aid in communication, e.g., between the user and other users via the audio device 10.

The audio device 10 can also include a transducer 90 (e.g., electroacoustic transducer or bone conduction transducer) for providing an audio output to a user. In certain cases, as depicted in the example in FIG. 1, the transducer 90 includes a headphone 90A. In this particular depiction, the transducer 90 includes a pair of headphones 90A, 90B, which can in some cases include passive and/or active noise reduction features for enhancing user hearing in a noisy environment. In the specific example depicted in FIG. 1, the headphones 90A, 90B include earphones (earbuds) for positioning in a user's ears. The transducer(s) 90 can be hard-wired and/or wirelessly connected with other components in the audio device 10 and/or other personal electronic devices such as a smart phone, smart watch, smart glasses (including audio playback capabilities), etc. In other examples, the transducer(s) can also be mounted directly to or within the audio device 10 or to a different type of structure coupled to the user's ears (i.e., an on-ear, around-ear, or near-ear coupling structure, some of which may leave the user's ears otherwise open to the environment).

In certain cases, the audio device 10 also includes electronics 100, which are shown in the example depictions in FIGS. 1 and 2 as being contained within the head mount 20, or substantially contained, such that a component can extend beyond the boundary of the head mount 20. In particular cases, as depicted in phantom, the electronics 100 are contained (or substantially contained) in a housing 105, which can be integral with the head mount 20 or detachably coupled to the head mount 20, such that the housing 105 can be removed from the head mount in particular cases. In certain implementations, separate, or duplicate sets of electronics 100 are contained in portions of the crown 30, e.g., proximate the temple region 110 on each side of the crown 30. However, certain components described herein can also be present in singular form.

In additional implementations, one or more components depicted in the electronics 100 are located in a separate, connected device 115. For example, processing and/or control components can be located in a separate connected device 115 that is in communication with the electronics 100 physically located at the head mount 20. In some cases, the device 115 includes a smart device such as a smart phone, tablet, wearable communication device, controller, etc., that is configured to communicate with one or more electronic components in the audio device 10.

Figure 4:
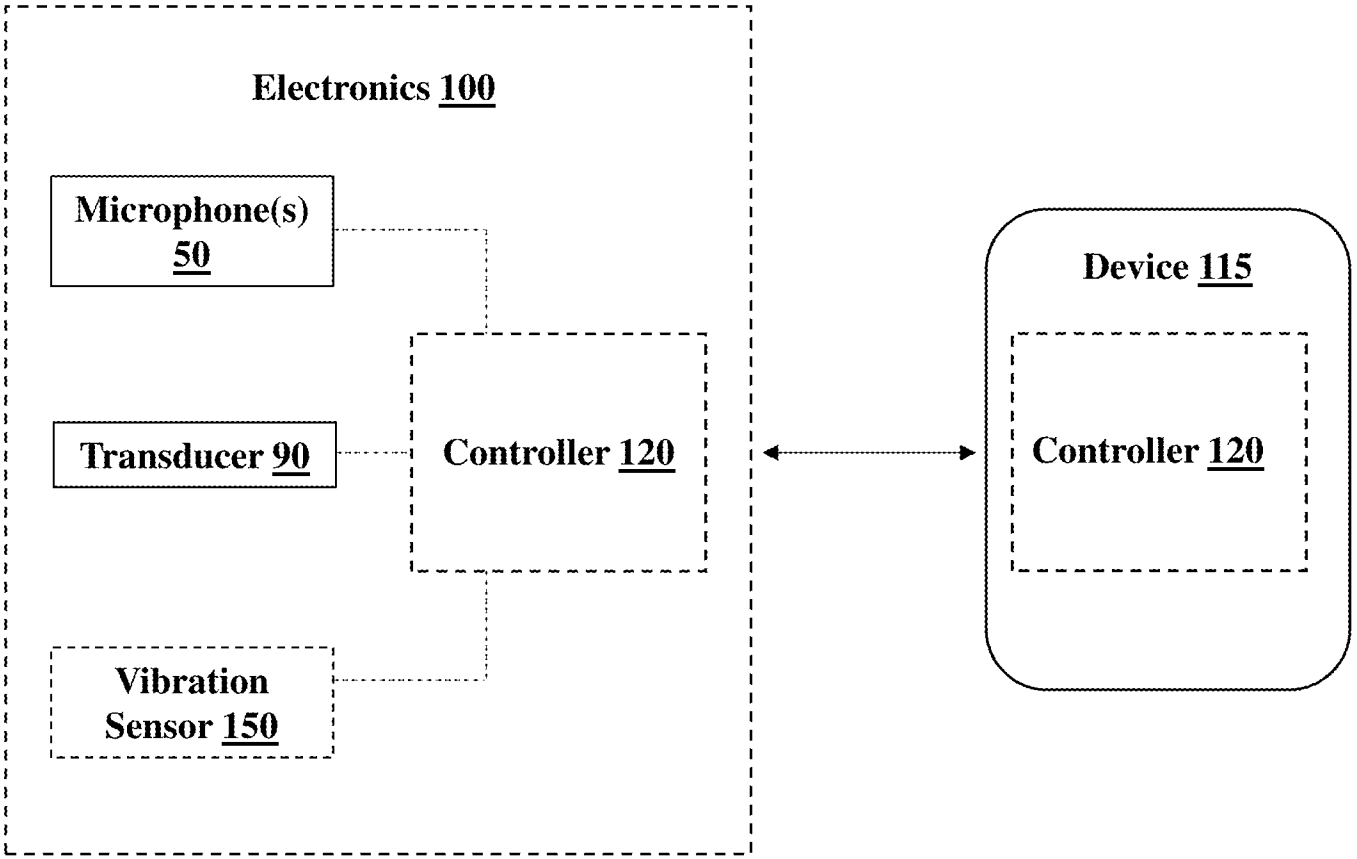
FIG. 4 is a schematic system diagram of electronics in an audio device according to various implementations.

FIG. 4 shows a schematic depiction of the electronics 100 that can be contained within the audio device 10 (FIG. 1), as well as communication between these components and the separate device 115. It is understood that one or more of the components in electronics 100 may be implemented as hardware and/or software, and that such components may be connected by any conventional means (e.g., hard-wired and/or wireless connection). It is further understood that any component described as connected or coupled to another component in audio device 10 or other systems disclosed according to implementations may communicate using any conventional hard-wired connection and/or additional communications protocols. In various particular implementations, separately housed components in audio device 10 are configured to communicate using one or more conventional wireless transceivers.

As shown in FIG. 4, the electronics 100 (e.g., contained within the head mount 20, and/or in the connected device 115) can include a controller 120 that is configured to perform control functions according to various implementations described herein. The controller 120 can include conventional hardware and/or software components for executing program instructions or code according to processes described herein. For example, controller 120 may include one or more processors, memory, communications pathways between components, and/or one or more logic engines for executing program code. Controller 120 can be coupled with other components in the electronics 100 via any conventional wireless and/or hardwired connection which allows controller 120 to send/receive signals to/from those components and control operation thereof.

Electronics 100 can include other components not specifically depicted herein, such as one or more power sources, motion detection systems (e.g., an inertial measurement unit, or IMU), communications components (e.g., a wireless transceiver (WT)) configured to communicate with one or more other electronic devices connected via one or more wireless networks (e.g., a local WiFi network, Bluetooth/Bluetooth Low Energy connection, or radio frequency (RF) connection), and amplification and signal processing components (e.g., one or more digital signal processors (DSPs)). It is understood that these components or functional equivalents of these components can be connected with, or form part of, the controller 120.

In certain implementations, the electronics 100 can include a voice enhancement system (or voice pick-up system) which may be part of the controller 120 and/or part of any hardware and/or software construct described herein. The voice enhancement system is configured to enhance user voice signals in the presence of noise.

In various optional implementations, the audio device 10 further includes a voice activity detection system (or simply, "VAD system") that is configured to detect voice activity, e.g., from the user of the audio device 10, and indicate a presence of that voice activity for enhancing the acoustic response from the microphones 50. In certain implementations, the VAD system is implemented as hardware and/or software in the electronics 100 (at the head mount 20 and/or at the connected device 115), and in some cases, can execute functions as part of, or in cooperation with, the voice enhancement system. Portions of the VAD system can be located in the controller 120, however, in other implementations, functions of the VAD system can be performed by another hardware and/or software system coupled with the controller 120 or otherwise contained in electronics 100. In particular cases, functions of the VAD system are used in the voice pick-up (enhancement) system that is configured to aid in enhancing the user's voice signals in the presence of noise, e.g., by freezing the adaptation of filter coefficients in an adaptive filter when voice activity is present. Additional details of processes performed by the voice enhancement system and the VAD system are described in co-pending U.S. patent application Ser. No. 16/571,511 ("Audio Processing for Wearables in High-Noise Environment"), filed herewith on Sep. 16, 2019, which is herein incorporated by reference in its entirety.

In particular cases, the VAD system includes or otherwise utilizes inputs from physical sensors at the audio device 10. For example, in some implementations, the VAD system includes a vibration detection system, for example, at least one vibration sensor 150 located at one or more locations on the audio device 10. In some cases, the vibration sensor 150 includes an accelerometer (e.g., one or more multi-axis accelerometer(s)) or a bone conduction microphone. In some cases, the vibration sensor 150 is mounted to the crown 30 or the suspension system 52 (FIG. 3). In still further implementations, e.g., where the vibration sensor 150 includes one or more bone conduction microphones, the bone conduction microphones are located on the crown 30, suspension system 52 and/or next to or proximate the transducers 90 (FIG. 1) in order to detect vibration from the user's inner ear bones. In certain implementations, the VAD system includes a plurality of vibration sensors 150 at distinct locations for enhancing the bone conduction vibration response. In other cases, as noted herein, the VAD system includes or is otherwise coupled with another motion detection system, such as an optical sensor positioned to detect movement of the user's mouth, e.g., while speaking.

FIGS. 1 and 2 illustrate one of several potential locations for the vibration sensor 150 along the crown 30, e.g., proximate the temple region 110 in some cases, and/or proximate the rear 140 of the crown 30. In particular aspects, the vibration sensor 150 is mounted to the inside surface 160 of the crown 30, e.g., along any portion of the crown 30 that provides contact with the user's head. In additional cases, for example as depicted in FIG. 3, the vibration sensor 150 is mounted to the back strap 54 of the head mount 20, e.g., a strap that spans at least a portion of the back of the user's head. In additional cases, as shown in FIG. 3, the vibration sensor 150 can be located at any position along the suspension system 52 as described with reference to the crown 30, e.g., proximate the user's ear, temple, forehead, etc. Example locations of vibration sensors 150 along the suspension system 52 are further illustrated in FIG. 3. In still further examples, the vibration sensor(s) 150 are located on a wearable structure such as on the wiring connecting transducers 90 to one another or to other devices, or in a mount for a separate wearable device (e.g., an over-ear mount for transducers 90 or other hardware in a communications system). In various implementations, for example where the vibration sensor 150 includes an accelerometer, the VAD system can be configured to detect vibration of the user's bones, e.g., as the user speaks.

In additional cases, the VAD system includes or otherwise receives signals from one or more microphones to validate voice detection. For example, in some cases, the VAD system is configured to use signals detected by one or more microphones 50 to validate voice detection. In these cases, the VAD system includes or is otherwise connected with at least one microphone 50 selected from the plurality of microphones 50 located on the brim 40, or an additional microphone 50A mounted elsewhere on the audio device 10 (e.g., a microphone 50A mounted to an inside surface 160 of the crown 30 or to a back strap of the head mount 20) for validating detected voice activity (e.g., detected via bone conduction at the vibration sensor 150). Several example locations for the additional microphone 50A are depicted in FIGS. 1 and 2. In various particular implementations, the additional microphone 50A is located in close proximity to the vibration sensor 150 (e.g., within 5-10 centimeters, or several inches).

In various implementations, signals from the vibration sensor 150 and the additional microphone 50A can be used to enhance accuracy of voice detection. That is, in a head-worn system such as the audio device 10, a vibration sensor 150 such as an accelerometer can be located such that it makes contact with the user's head in order to effectively sense bone-conducted vibration from the user's speech. In certain cases, the audio device 10 can further enhance adaptive acoustic response functions using input(s) from one or more additional microphones 50A. That is, the microphone-based voice activity approach described according to various implementations can enhance the robustness of the audio device 10 in situations where reliable skin contact between the accelerometer and the user's skin is not feasible.

While certain accelerometers provide reliable bone conduction voice pickup, some of these accelerometers can be sensitive to acoustic noise. In particular cases, this sensitivity to acoustic noise can make it difficult to define universal bone-conducted voice activity thresholds. In addressing this issue, in various particular implementations, the audio device 10 includes a vibration sensor 150 (e.g., accelerometer) and a microphone (e.g., additional microphone 50A) located proximate one another but separated from the user's mouth, e.g., proximate the rear 140 of the crown 30 or on the back strap 54 (FIG. 3). In these cases, the VAD system can use the noise pickup signal from the additional microphone 50A to filter out the acoustic noise in the signal from the accelerometer 150. This configuration of the accelerometer and additional microphone(s) 50A can provide a reliable bone conducted signal and enable clear definition of thresholds for voice activity detection, as well as enable use of the additional microphone(s) 50A for voice communication.

In still further implementations, as noted herein, the vibration sensor 150 can be mounted in the head mount 20 in a manner configured to detect vibration of one or more portions of the user's head. For example, vibration sensor 150A is configured to detect vibration of the user's temple region. Vibration sensor 150B can be configured to detect vibration from the user's jaw. In additional implementations, one or more vibration sensors 150 and/or additional microphones 50A are located along straps or other mounting equipment within or coupled to the head mount 20, e.g., to detect bone conduction (and verify such detection) from other regions of the user's head.

In still further implementations, as noted herein, the VAD system can include or otherwise be coupled with additional sensors that are capable of detecting voice activity of the user. For example, the VAD system can include (or otherwise be coupled) with one or more optical sensors (e.g., a camera) or infra-red (IR) sensors for detecting movement of the user's mouth and thus flagging voice activity.

Returning to FIGS. 1 and 2, in various implementations the brim 40 extends from the crown 30 by a distance (Db) that locates the microphones 50 at a relative angle to the mouth of the user such that the microphones are positioned to enhance the acoustic response from the user's voice signals. That is, in addition to at least partially shielding the microphones 50 from wind in the ambient environment, the brim 40 enables location of the microphones 50 in a location that is either directly above, or in front of the user's nose and mouth region. In some cases, the microphones 50 are positioned at an angle relative to the vertical plane that intersects the user's nose, such that the microphones 50 can detect voice signals from the user with a clear path to the user's mouth which can improve the consistency of the array performance.

In some cases, the audio device 10 is particularly well suited to detect voice signals from the user in noisy ambient conditions, for example, in industrial use cases, outdoor use cases, etc. In particular cases, the microphones 50 are positioned on the brim 40 to detect voice signals from the user in such noisy ambient conditions. In some examples, the noisy ambient conditions are defined by conditions where the ambient sound pressure level (SPL) exceeds approximately 75 decibels (dB).

In some additional implementations, as shown in FIG. 1, the audio device 10 includes an additional microphone assembly 170 that is coupled with the head mount 20. In various implementations, the microphone assembly 170 includes a set of microphones (e.g., within or coupled to a housing 180) that are connected to a fixed arm 190 extending from the head mount 20 toward the mouth of the user. In some cases, the arm 190 is approximately 5-10 centimeters (or, several inches) long, and is fixed in position relative to the head mount 20. In some cases, the arm 190 extends from housing 105, but can be physically coupled with other portions of the head mount 20, e.g., the crown 30 or the suspension system 52 (FIG. 3). Unlike a conventional boom-style microphone, the microphone assembly 170 is fixed relative to the head mount 20, such that the user need not adjust the position of the microphone assembly 170 for different use cases. In various implementations, the microphones in the assembly 170 act as one or more additional sub-arrays (in addition to the microphones 50 mounted to the brim 40) for enhancing detection of voice signals from the user. The microphones in assembly 170 can be located closer to the user's mouth than those microphones 50 mounted at the brim 40, and are positioned at a distinct location in the noise field than those brim-mounted microphones 50.

With continuing reference to FIGS. 1-3, the audio device 10 can detect voice signals from the user by enhancing the acoustic response at the microphones 50 in one or more selected directions. That is, in some cases, the controller 120 is configured to combine a plurality of signals from the microphones 50 to provide an output signal that has an enhanced acoustic response in a selected direction. For example, the controller 120 is configured to combine signals from two or more microphones 50 to provide an output signal that has an enhanced acoustic response in a direction of the user's mouth. In still other cases, the controller 120 is configured to combine signals from two or more microphones 50 to provide an output signal that has an enhanced acoustic response in a forward-oriented direction, e.g., in front of the user. In various implementations, the controller 120 is configured to analyze and combine signals from distinct sub-arrays of the microphones 50 to enhance the acoustic response in the direction of the user's mouth. That is, the controller 120 can be configured to detect acoustic signals using distinct sub-arrays of microphones 50 and select detected signals that enhance the acoustic response correlated with the user's voice. Particular approaches for enhancing acoustic response in one or more directions are further illustrated in U.S. patent application Ser. No. 16/571,511 ("Audio Processing for Wearables in High-Noise Environment"), previously incorporated by reference herein.

In contrast to conventional systems for communicating in noisy environments, the audio devices described according to various implementations are configured to enhance communication while keeping the user immersed in the environment. The user can remain heads up and hands free in performing one or more tasks while still effectively communicating with others. That is, these audio devices can effectively enhance the user's voice in noisy environments without the need for a boom or other externally adjustable microphone.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Additionally, actions associated with implementing all or part of the functions described herein can be performed by one or more networked computing devices. Networked computing devices can be connected over a network, e.g., one or more wired and/or wireless networks such as a local area network (LAN), wide area network (WAN), personal area network (PAN), Internet-connected devices and/or networks and/or a cloud-based computing (e.g., cloud-based servers).

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

The term "approximately" as used with respect to values denoted herein can allot for a nominal variation from absolute values, e.g., of several percent or less.

A number of implementations have been described. Nevertheless, it will be understood that additional modifications may be made without departing from the scope of the inventive concepts described herein, and, accordingly, other implementations are within the scope of the following claims.

We claim:

1. A wearable audio device, comprising:

a head mount comprising:

a crown portion for resting on a head of a user, and a brim extending from the crown portion in a forward-oriented direction;

a plurality of microphones coupled to the brim of the head mount;

a voice activity detection (VAD) system coupled to the head mount; and a controller coupled with the plurality of microphones and the VAD system, the controller configured to combine a plurality of signals from the plurality of microphones to provide an output signal having an enhanced acoustic response in a selected direction.

2. The wearable audio device of claim 1, wherein the selected direction is a direction of a mouth of the user, and wherein the selected direction is selected based on an indicator of voice activity from the VAD system.

3. The wearable audio device of claim 1, wherein the selected direction is a forward-oriented direction.

4. The wearable audio device of claim 1, further comprising:

an additional microphone located proximate a rear of the crown; and an accelerometer located proximate the additional microphone, wherein the VAD system is configured to use a noise pickup signal from the additional microphone to filter out acoustic noise in a signal from the accelerometer.

5. The wearable audio device of claim 1, wherein the VAD system comprises at least one microphone selected from the plurality of microphones coupled to the brim of the head mount.

6. The wearable audio device of claim 1, wherein the VAD system comprises a vibration sensor.

7. The wearable audio device of claim 6, further comprising a suspension system coupled with the head mount, wherein the vibration sensor is mounted to at least one of: a back strap of the suspension system, or an inside surface of the crown portion.

8. The wearable audio device of claim 6, wherein the vibration sensor is an accelerometer for detecting vibration of bones of the user.

9. The wearable audio device of claim 1, further comprising a transducer coupled to the head mount and the controller, the transducer configured to provide an audio output, wherein the transducer is an earbud, wherein the plurality of microphones are arranged in two arrays that are approximately parallel with one another, wherein each array comprises at least two microphones, and wherein a first one of the arrays is located closer to an outer span of the brim than a second one of the arrays.

10. The wearable audio device of claim 1, wherein each microphone of the plurality of microphones is coupled to a lower surface of the brim, wherein an upper surface of the brim is shaped to shield the plurality of microphones from wind in the ambient environment.

11. The wearable audio device of claim 1, wherein the head mount further comprises a dome portion extending from the crown portion to cover a top of the head of the user, wherein the head mount comprises a rigid protective helmet or a hat.

12. The wearable audio device of claim 1, wherein the brim extends from the crown portion by a distance that locates the plurality of microphones at a relative angle to the mouth of the user such that the plurality of microphones is positioned to enhance an acoustic response from user voice signals.

13. The wearable audio device of claim 12, wherein the plurality of microphones is positioned on the brim to enhance voice detection while ambient sound pressure level (SPL) exceeds approximately 75 decibels (dB).

14. The wearable audio device of claim 1, further comprising an additional microphone assembly coupled with the head mount, the additional microphone assembly comprising:

an arm in a fixed position relative to the head mount; and at least one additional microphone coupled with the arm.

15. The wearable audio device of claim 8, wherein the vibration sensor is mounted to an inside surface of the crown that provides contact with the user's head while the wearable audio device is worn.

16. A wearable audio device, comprising:

a head mount comprising:

a crown portion for resting on a head of a user, and a brim extending from the crown portion in a forward-oriented direction;

a plurality of microphones coupled to the brim of the head mount; and a voice activity detection (VAD) system coupled to the head mount, wherein the VAD system comprises a vibration sensor, wherein the brim extends from the crown portion by a distance that locates the plurality of microphones at a relative angle to the mouth of the user such that the plurality of microphones is positioned to enhance an acoustic response from user voice signals.

17. The wearable audio device of claim 16, further comprising:

a suspension system coupled with the head mount, wherein the vibration sensor is mounted to at least one of: a back strap of the suspension system or an inside surface of the crown portion, wherein the vibration sensor is an accelerometer for detecting vibration of bones of the user.

18. The wearable audio device of claim 17, further comprising a controller coupled with the plurality of microphones and the VAD system, the controller configured to combine a plurality of signals from the plurality of microphones to provide an output signal having an enhanced acoustic response in a selected direction.

19. A wearable audio device, comprising:

a head mount comprising:

a crown portion for resting on a head of a user, and a brim extending from the crown portion in a forward-oriented direction;

a plurality of microphones coupled to the brim of the head mount;

a voice activity detection (VAD) system coupled to the head mount, wherein the VAD system comprises a vibration sensor, wherein the brim extends from the crown portion by a distance that locates the plurality of microphones at a relative angle to the mouth of the user such that the plurality of microphones is positioned to enhance an acoustic response from user voice signals; and a controller coupled with the plurality of microphones and the VAD system, the controller configured to combine a plurality of signals from the plurality of microphones to provide an output signal having an enhanced acoustic response in a selected direction, wherein the selected direction is toward a mouth of the user and is selected based on an indicator of voice activity from the VAD system.

20. The wearable audio device of claim 19, further comprising:

a suspension system coupled with the head mount, wherein the vibration sensor is mounted to at least one of: a back strap of the suspension system or an inside surface of the crown portion, wherein the vibration sensor is an accelerometer for detecting vibration of bones of the user.

* * * * *